US007234474B2

(12) United States Patent
Byun

(10) Patent No.: US 7,234,474 B2
(45) Date of Patent: Jun. 26, 2007

(54) COSMETICS BRUSH

(76) Inventor: Young-Chul Byun, 206-1702, UjangsanLotteNakchundaeAPT, 1145, Hwagok-Dong, Gangseo-Gu, Seoul (KR) 157-010

( * ) Notice: Subject to any disclaimer, the term of this patent is extended or adjusted under 35 U.S.C. 154(b) by 198 days.

(21) Appl. No.: 11/046,798

(22) Filed: Feb. 1, 2005

(65) Prior Publication Data

US 2005/0188999 A1 Sep. 1, 2005

(30) Foreign Application Priority Data

Feb. 27, 2004 (KR) ..... 10-2004-0013344

(51) Int. Cl.
*A45D 44/18* (2006.01)

(52) U.S. Cl. ..... 132/313

(58) Field of Classification Search ..... 132/317, 132/318, 313, 290, 289; 222/192, 518
See application file for complete search history.

(56) References Cited

U.S. PATENT DOCUMENTS 3,093,857 A * 6/1963 Hersh ..... 401/190
6,039,052 A * 3/2000 Choi ..... 132/313
6,056,470 A * 5/2000 Nehashi et al. ..... 401/279
6,234,181 B1 * 5/2001 Lou ..... 132/313
6,363,948 B2 * 4/2002 Choi ..... 132/313
6,418,939 B1 * 7/2002 Byun ..... 132/313
6,508,256 B2 * 1/2003 Byun ..... 132/313
2002/0040720 A1 * 4/2002 Byun ..... 132/112
2002/0148482 A1 * 10/2002 Byun ..... 132/313
2004/0089318 A1 * 5/2004 Tahara ..... 132/317
2004/0250833 A1 * 12/2004 Jang ..... 132/313

* cited by examiner

*Primary Examiner*—Todd E. Manahan
*Assistant Examiner*—Rachel A. Running
(74) *Attorney, Agent, or Firm*—Birch, Stewart, Kolasch & Birch, LLP

(57) ABSTRACT

A cosmetic brush for applying make-up which includes a brush member, a main body located at the lower portion of the brush member and a movable bar connected to an intermediate coupler and reciprocally disposed to generate air pressure and to discharge cosmetic powder from the main body to the brush member by pushing up the main body when applying the make-up, wherein the movable bar includes vertical grooves and a press-ring and can move up and down by pushing the main body combined with the intermediate coupler containing the movable bar, so that the cosmetic powder housed in the body is conveyed through a powder transport duct positioned at the top portion of an upper movable body through the vertical grooves in the movable bar formed on top portion of the intermediate coupler and then distributes the cosmetic to the brush member side in a desirable distribution, resulting in improved convenience for the make-up user with an easier and simpler operation.

3 Claims, 11 Drawing Sheets

COSMETICS BRUSH

This non-provisional application claims priority under 35 U.S.C. § 119(a) based on Patent Application No. 2004-0013344 filed in Korea on Feb. 27, 2004, the subject matter of which is herein incorporated by reference.

BACKGROUND OF THE INVENTION

1. Field of the Invention

The present invention relates to a cosmetics brush, more particularly, a cosmetics brush for applying make-up including a brush member, a main body located at lower portion of the brush member and a movable bar connected to an intermediate coupler and for moving reciprocally to generate air pressure and to discharge cosmetic powder out of the main body to the brush member by pushing up the main body for applying the make-up The movable bar which includes vertical grooves, can be moved up and down by pushing the main body combined with the intermediate coupler having the movable bar, so that the cosmetic powder, housed in the main body, passes a powder transport duct positioned on the top portion of an upper, movable body through the vertical grooves in the movable bar formed at top portion of the intermediate coupler 20 and then sprays the cosmetic powder out to the brush member side in a desirable distribution, resulting in improved convenience for applying the make-up by the user.

2. Description of the Related Art

Generally, cosmetic products are classified into liquid status, solid status and a mixture of the liquid and the solid cosmetics. In recent years, liquid cosmetics in the form of lipstick or foundation for convenient use of consumers has been developed, which usually comprises cosmetics charged in a housing in the form of a pencil and discharged toward an upper brush member of the housing when turning a part of the housing in the right or left direction. Various constructional forms of such pencil type cosmetics have been proposed and used in many applications.

Representative cosmetics brushes frequently used have been manufactured as a combination of a brush and a main body, wherein the brush is covered with cosmetic powder at the time of make-up. Because both the brush and the powder are separately held, it is inconvenient to both carry and hold these items and, in turn, it is a difficult to use the cosmetics brush.

A variety of cosmetics brushes have been recently proposed which have the desirable construction of storing cosmetic powder in the main body, formed as a housing, and discharging the cosmetics powder from the main body using air pressure, as illustrated in FIGS. 10 and 11, taken from Korean Utility Model Reg. No. 253672.

The cosmetic brush comprises a first body 102 in the form of a tube with open top and bottom ends for receiving cosmetics power 103; a second body 106 connected to lower circumferential side and having outlet hole 107 among central portion of the top side, and a brush member 108 communicating the outlet hole 107 at the front end; an up/down transfer shaft 109 comprising a spring 110 connected to the outer circumferential side of front end, the front end portion being connected to the outlet hole 107 of the second body 106 and the spring 110 supported on the outer circumference of the top end; and a top cap 113 connected to the top end of the first body 102 to extend the top end portion of the up/down transfer shaft 109 and support it.

With such a construction, the cosmetics brush 100 is used by pushing a button 102 which protrudes upward from the top end of the up/down transfer shaft 109 during make-up. The spring 110 provided at top end of the up/down transfer shaft 109 permits the shaft 109 to move up and down and, in turn, the cosmetics powder 103 received in the body 102 passes through the outlet hole 107 having a front end portion formed in the second body 106 and moves to the outside, that is, is easily supplied to the brush member 108, whereby the cosmetics brush can conveniently use the cosmetics powder.

Herein, the cosmetics powder 103 is provided to the brush member 108 through the outlet hole 107 by directly passing the top end of the up/down transfer shaft 109 through the outlet hole 107.

However, since such a conventional cosmetic brush mentioned above discharges the cosmetics powder 103 to the brush member 108 by the top end of the up/down transfer shaft 109, it difficult to achieve an even and/or uniform distribution of the powder 103 due to the inherent constructional limitations of the up/down transfer shaft 109. In addition, swaying of the cosmetics brush itself 100 which allows discharge of the powder 103 to the brush member side 108 also causes an inconvenience in the use thereof.

Moreover, a button 112 formed on a top cap side 113 always protrudes outside due to the repulsing force of the spring 110 and, in the case where it strikes any personal articles while being carried where an outer force is applied to the brush, the button 112 may move and cause undesirable discharge of the powder 103 to the brush member side 108, thereby resulting in spoilage and/or damage of the articles. Still further, when the cosmetics brush is carried in humid places or in a wet atmosphere or has not been used for a long period of time, the powder 103 contained in the body 102 and remaining in the outlet hole 107 becomes hardened due to moisture, creating difficulty in discharging and/or distribution of the cosmetics powder 103.

SUMMARY OF THE INVENTION

It is, therefore, an object of the present invention is to solve the above problems, in particular, to provide a cosmetics brush including a brush member, a main body located at a lower portion of the brush member and a movable bar connected to an intermediate coupler for moving reciprocally to generate air pressure and to transfer cosmetic powder discharged from the main body to the brush member by pushing up the main body when applying the make-up. The movable bar includes vertical grooves and is adapted to move up and down by pushing the main body combined with the intermediate coupler containing the movable bar. The cosmetic powder stored in the main body passes a powder transport duct positioned on the top portion of an upper movable body through the vertical grooves in the movable bar formed on top portion of the intermediate coupler 20, and then sprays out to the brush member side in desirable distribution, thereby resulting in an improvement in convenience for applying the make-up by providing an easier and more simple operation.

BRIEF DESCRIPTION OF THE DRAWINGS

The above object, features and advantages of the present invention will become more apparent to those skilled in the related art from the following detailed description of preferred embodiments taken in conjunction with the accompanying drawing, in which.

DETAILED DESCRIPTION OF THE PREFERRED EMBODIMENT

The present invention will be described in more detail with reference to the accompanying drawings and following embodiments which are presented for purpose of illustration only and should not be construed to limit the scope of the present invention.

Figure 1:
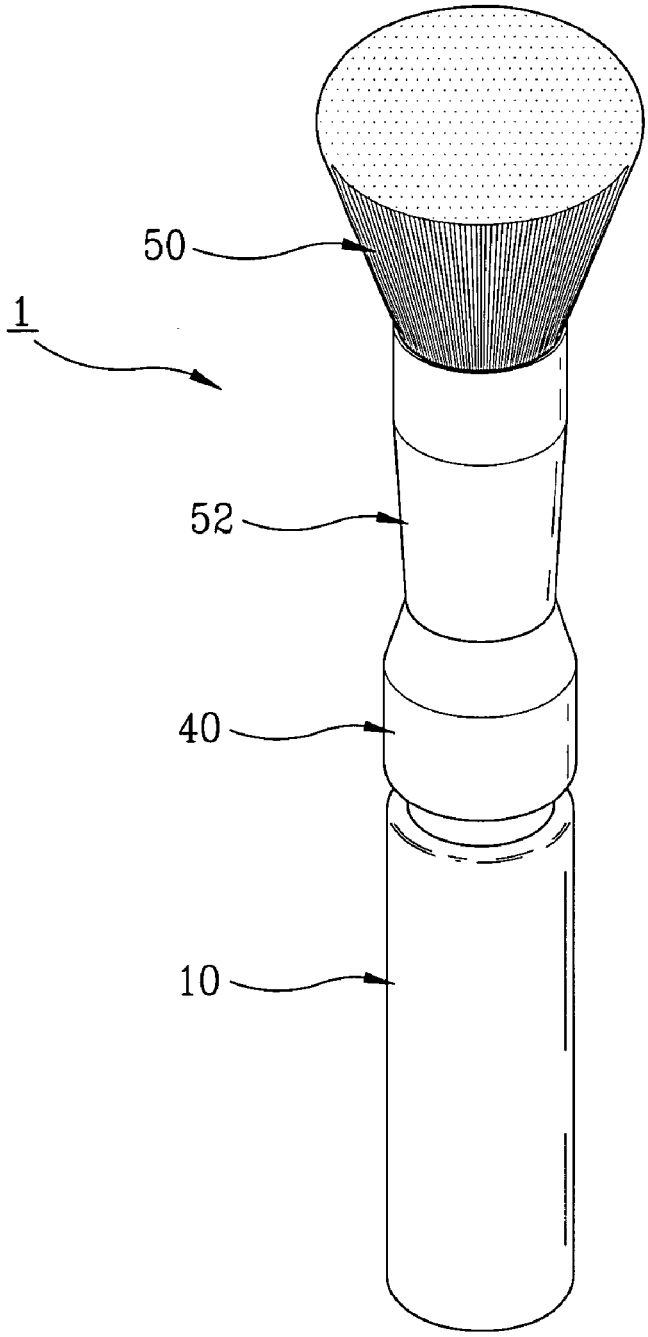
FIG. 1 is a perspective view illustrating an example of the present invention.
Figure 2:
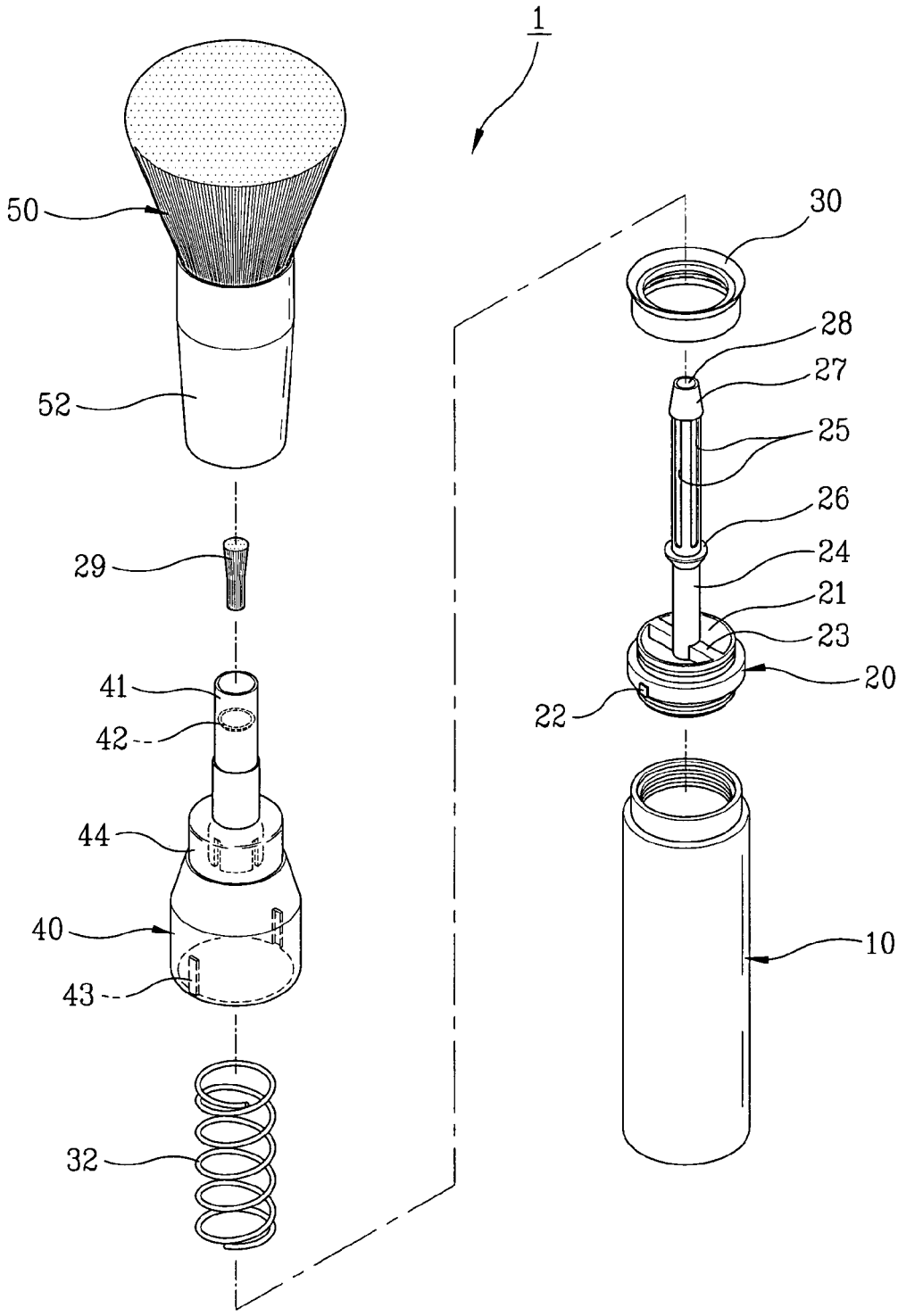
FIG. 2 is an exploded perspective view illustrating the example of the present invention.
Figure 3:
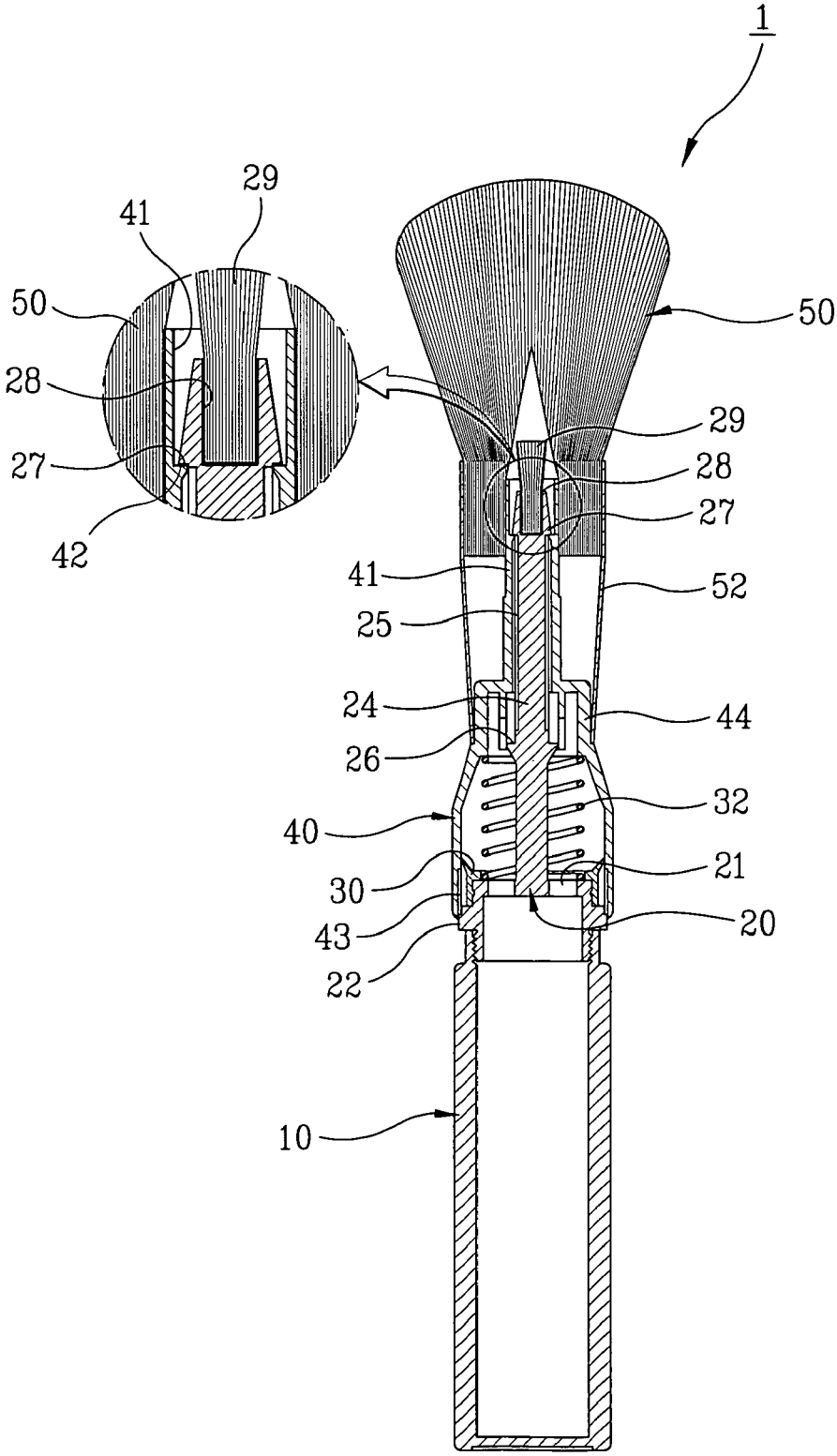
FIG. 3 is a sectional view of FIG. 1 taken along Line A—A.
Figure 4:
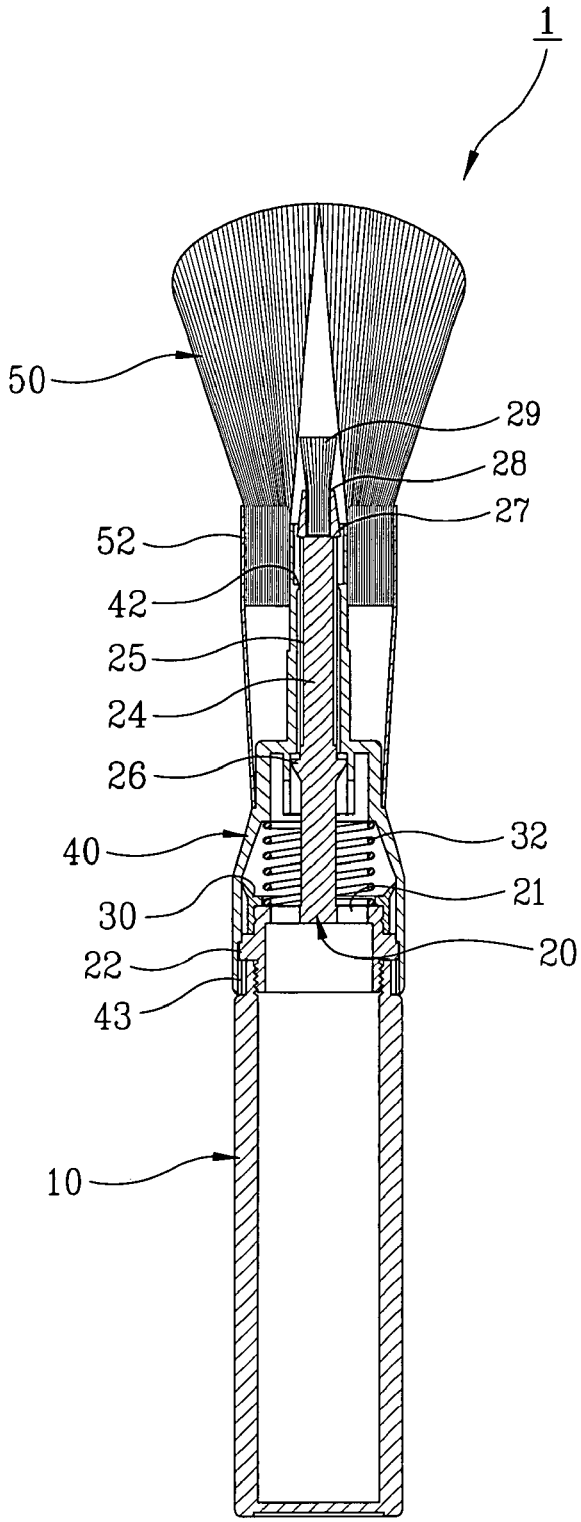
FIG. 4 is a sectional view of FIG. 1 showing the example of the present invention wherein the main body thereof is pushed up.

FIG. 1 is a perspective view illustrating an example of the present invention. FIG. 2 is an exploded perspective view illustrating the example of the present invention. FIG. 3 is a sectional view of FIG. 1 taken along Line A—A, and FIG. 4 is a sectional view of FIG. 1 showing the present invention with the main body thereof pushed up.

With regard to a cosmetics brush 1 of the present invention, cosmetics powder is discharging in a certain amount to a brush member 50 through vertical grooves 25 formed around a movable bar 24 by following the steps of: gripping an upper movable body 40 located at bottom portion of the brusher member 50 with one hand while pushing up a main body 10 by the other hand to enable the main body 10 to screw-coupled to the top portion thereof; moving up and down an intermediate coupler 20 built-in to the bottom portion of the upper movable body 40 along a guide groove 43 formed in the bottom portion of the upper movable body 40; and applying pressure to a powder transport duct 41 with a press-ring 26 located in the movable bar 24 connected to top portion of the intermediate coupler 20.

Briefly, by pushing up the Main body 10, the press-ring 26 formed around the movable bar 24 moves into the powder transport duct 41 and applies pressure thereto to discharge the cosmetics powder out of the duct 41, while the intermediate coupler 20 falls down and returns to its original position by the repulsive force of the spring 32 provided at the top portion of the intermediate coupler 20 so that the body is closed by an opening/closing element 27 formed on top portion of the movable bar 24 to prevent the discharge of the cosmetic powder. Accordingly, the present inventive cosmetics brush 1 can freely and semi-automatically control discharging/blocking of the cosmetics powder using the movable bar 24 integrated with the intermediate coupler 20 as well as the spring 32 through its construction as described below.

The cosmetics brush 1 according to the present invention comprises the main body 10 which is formed with a screw part coupled to another screw part in the bottom portion of the intermediate coupler 20.

The intermediate coupler 20 which is joined with the main body 10 at the top portion thereof has a pass-through opening 21 and two protrusions 22 on both sides around the intermediate coupler 20. On the middle of the opening 21, vertical grooves 25 supported by a supporter 23 are provided. In addition, the movable bar 24 is longitudinally located on the middle of the opening 21 and is provided with the press-ring 26 and the opening/closing part 27.

Alternative closing member 30 is fitted into the top portion of the intermediate coupler 20.

The intermediate coupler 20 having the specified construction described above, is inserted and coupled inside the powder transport duct 41 provided at the top portion of the upper movable body 40 with the spring 32 being disposed around the movable bar 20.

The protrusions 22 formed around the intermediate coupler 20 are fitted into the guide groove 43 existing on the lower inside of the upper movable body 40, possible to vertically move within the guide groove 43, while the opening/closing part 27 formed with a threshold at the top portion of the movable bar 24 is coupled across the top portion of a threshold 42 in the inner top portion of the powder transport duct 41.

As a result, the intermediate coupler 20 coupled to the main body 10 and the upper movable body 40 are engaged not only in the opening/closing part 27 on the top portion of the movable bar 24 fitted into the powder transport duct 41 but also with the threshold 42 in the powder transport duct 41, thereby resulting in a solid and stable connection without the danger of a release thereof.

By pushing up the main body 10 to extend the movable bar 24 out of the top portion of the powder transport duct 41 when the intermediate coupler 20 and the upper movable body 40 are connected to each other, fitting an auxiliary brush with vertical grooves 29 to distribute and discharge the powder into a slit 28 formed on the top portion of the movable bar 41, and fitting a clip 52 corresponding to the brush member 50 into a slit portion 44 formed in the upper movable body 40, the present inventive cosmetics brush 1 is completed.

The functional effect of the present invention having such construction described above will be more understood with reference to the following description.

As shown in FIGS. 1 to 4, the cosmetics powder is charged in the main body 10. The top portion of the main body 10 is spaced from the bottom end part of the upper movable body 40 in a desirable interval by the repulsive force of the spring 32. The threshold 42 is formed on the top portion of the upper movable body 40 and inside the powder transport duct 41.

The opening/closing part 27 formed on top end part of the movable bar 24 of the intermediate coupler 20 is coupled and engaged to the above threshold 42 to close the same.

In this construction to receive the cosmetics powder, the user needs to only push the main body 10 upward with one hand while gripping the upper movable body 40 with the other hand so that the threshold 42 formed in the powder transport duct 41 and closed by the opening/closing part 27 can discharge the powder to the brush member 50 at the time of making-up. When the main body 10 is pushed up, the movable bar 24 above the intermediate coupler 20 is raised and allows the press-ring 26 around the movable bar 24 to apply pressure to inner part of the powder transport duct 41 inside the upper movable body 40, thereby transporting the cosmetics powder to the powder transport duct side 41 through the vertical grooves 25 arranged around the movable bar 24 and discharging the same to the auxiliary blush 29 in the desired amount, as shown in FIG. 4. The auxiliary brush 29 has the role of distributing the powder uniformly around the brush member 50.

Subsequently, when the force pushing up the main body 10 is removed, both of the intermediate coupler 20 mounted with the movable bar 24 and the main body 10 return to their original positions by the repulsive force of the spring 32 supporting the intermediate coupler 20.

As described above, the repetition of pushing and releasing the main body 10 discharges the powder from the main body 10 to the brush member side 50 to be used for make-up.

Although the brush member 50 is illustrated in the drawings in a turned-up position for convenience, when in use it is frequently facing in the downward direction.

FIGS. 5 to 9 illustrate an alternative embodiment of the present invention.

Figure 5:
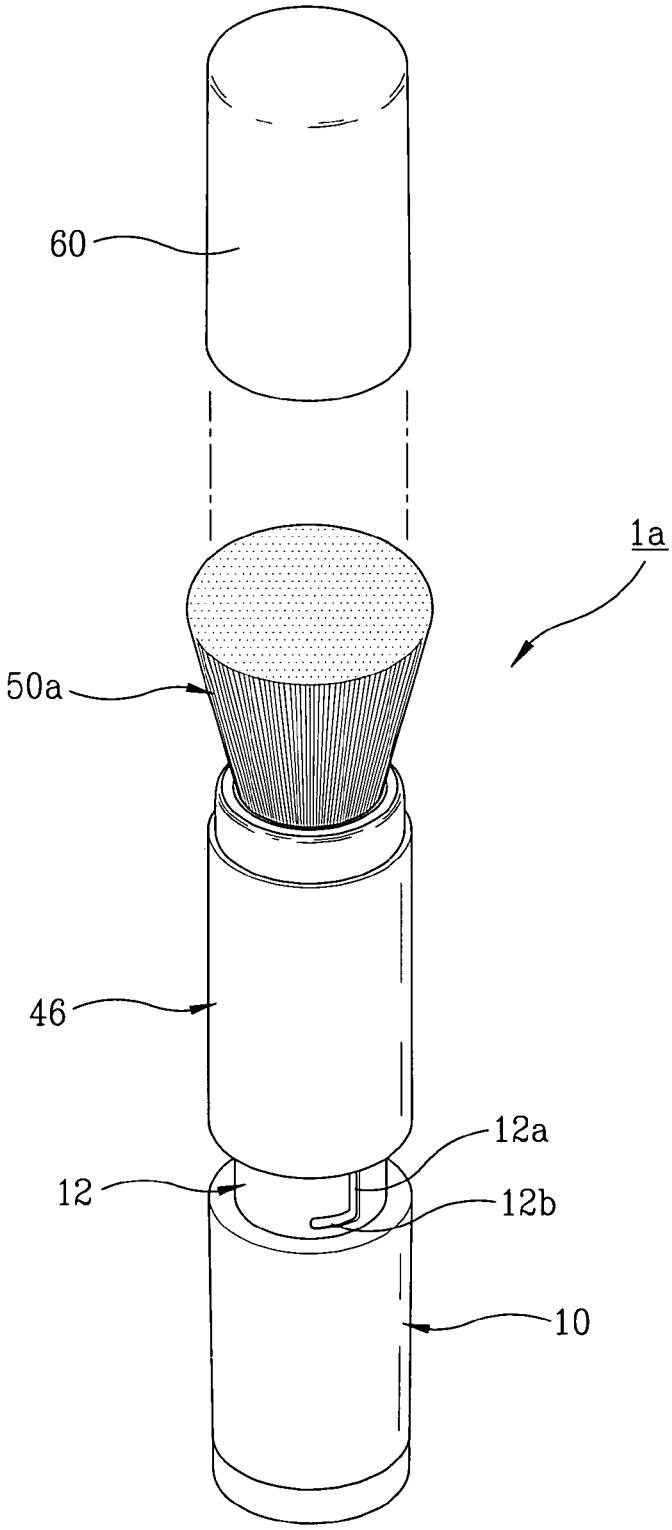
FIG. 5 is a perspective view illustrating a further example of the present invention.
Figure 6:
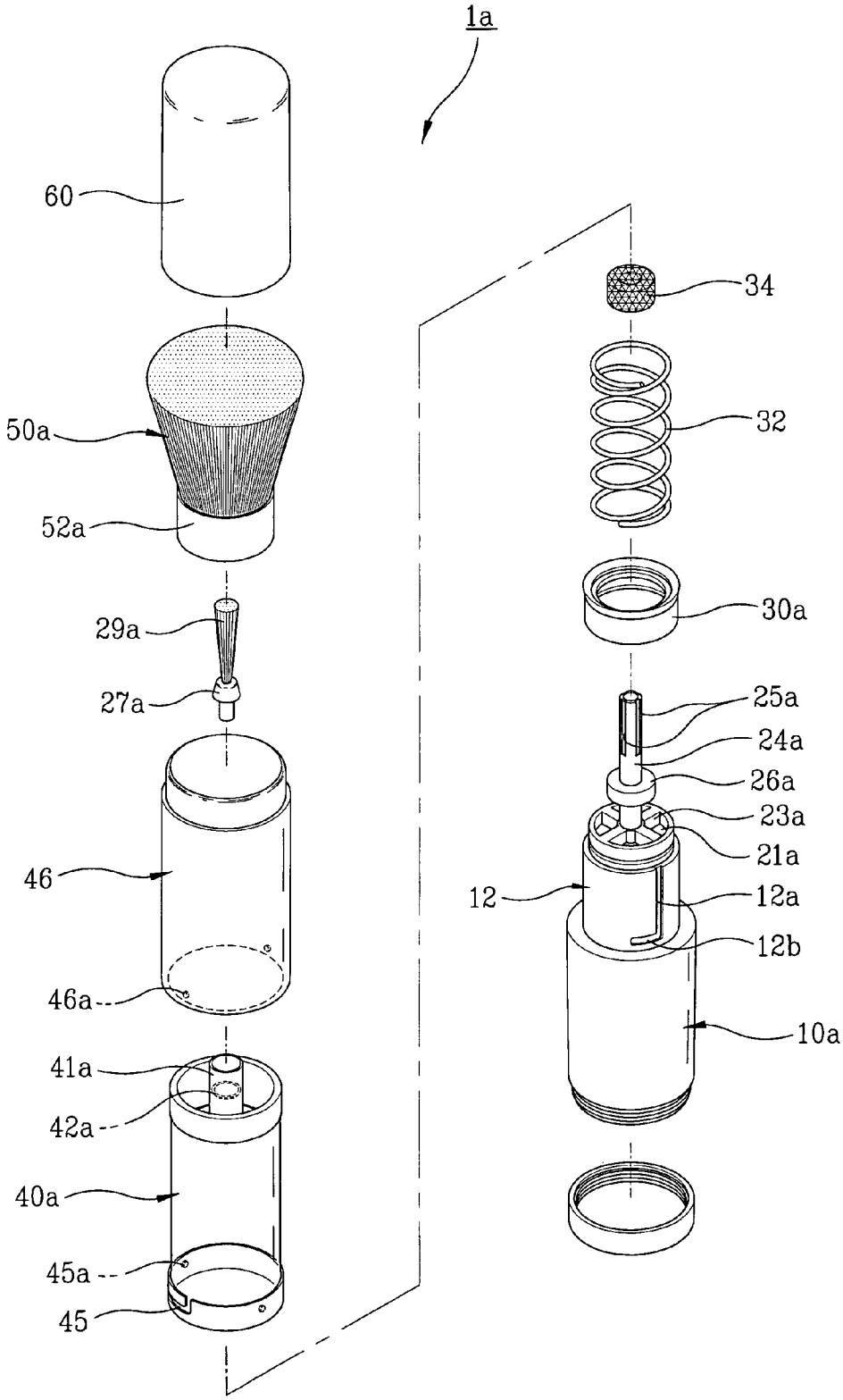
FIG. 6 is an exploded perspective view illustrating the example of FIG. 5 of the present invention.
Figure 7:
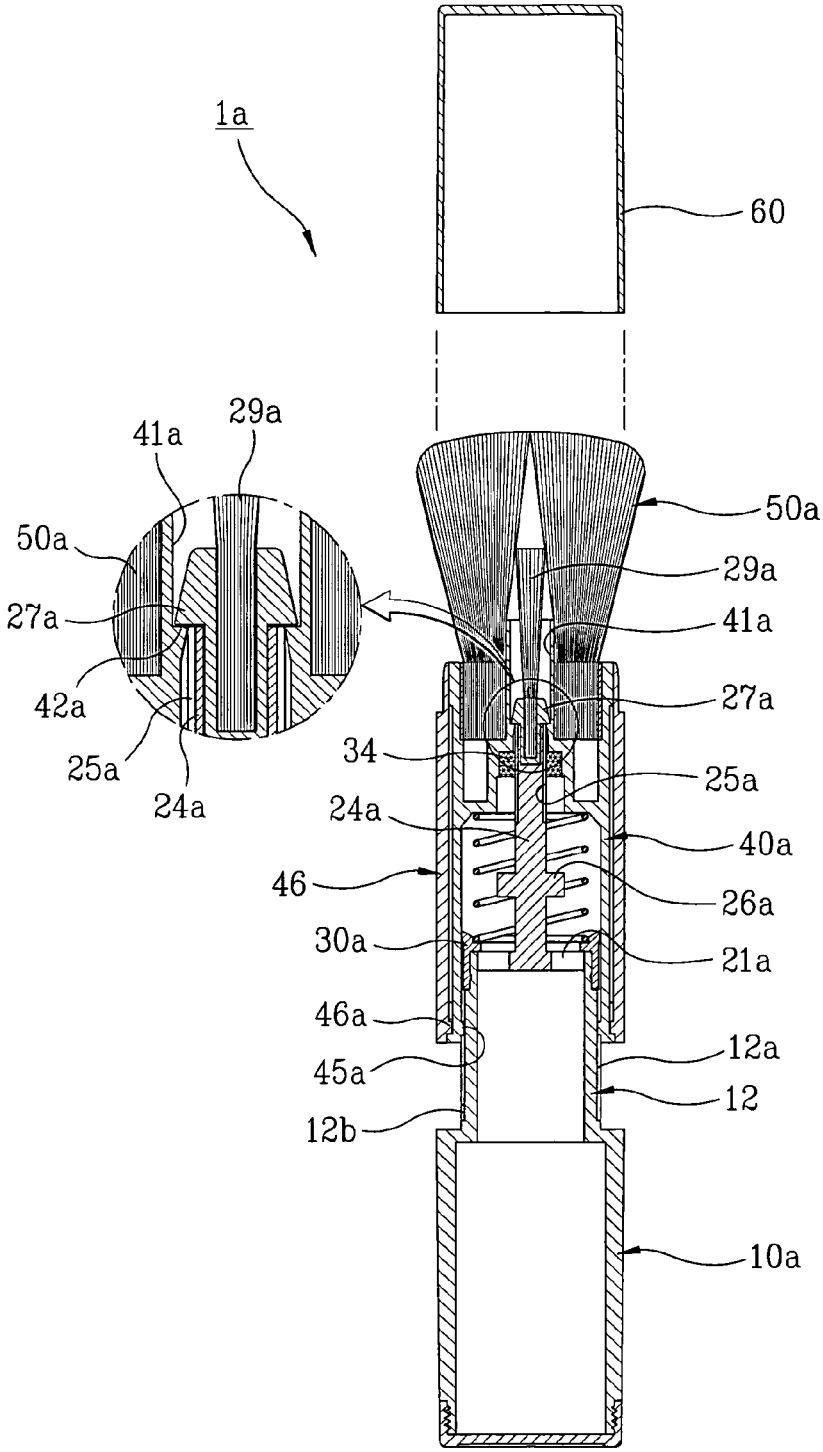
FIG. 7 is a sectional view of FIG. 6 taken along Line B—B.

As shown in FIGS. 5 and 6, a cosmetics brush 1*a* comprises a main body 10*a* to receive the cosmetics powder, an upper movable body 40*a* and a movable member 12 formed with a moving groove 12*a* and an engaging groove 12*b* at both desirable positions around the main body 10*a*. The upper movable body 40*a* has a protrusion 45*a* and another engaging groove 45 on inner side and on the outer side of the bottom end part of the upper movable body 40*a*. The protrusion 45*a* fits into the moving groove 12*a* around the movable member 12 to move upward/downward, while being controlled in its movement when it is fitted into the engaging groove 12*b*.

The movable member 12 formed above the main body 10*a* has a pass-through opening 21*a* with a supporter 23*a* in the middle of the opening and the movable bar 24*a* is set up perpendicular to the supporter 23*a* as a base.

Around the movable bar 24*a*, vertical grooves 25 are formed while a press-ring 26*a* is located on lower desirable position of the movable bar 24*a*.

Further, alternative sealing member 30*a* is fitted into and coupled at the top end part of the movable member 12.

This movable member 12 with the construction described above is fitted into and coupled with the upper movable body 40*a*. More particularly, a filter 34 is first inserted into the upper movable body 30*a* then a spring 32 is mounted around the movable bar 24*a*. Then, the movable bar 24*a* is forced to enter through a powder transport duct 41*a* formed on the inner, upper portion of the upper movable body 40*a*. On the top portion of the movable bar 24*a* is fitted a push-cap 27*a* having an auxiliary brush 29*a* for distributing powder to the movable bar 24*a* to be placed across a threshold 42*a* provided inside the powder transport duct 41*a*.

The movable member 12 formed at the top portion of the main body 10*a* has a specific construction with the push-cap 27*a* which is located at the top portion of the movable bar 24*a*, fitted into and coupled with the powder transport duct 41*a* and engaged in the threshold 42*a* so as not to be released.

In the above construction, the main body 10*a* is forcedly pushed upward so that top end part of the movable bar 24*a* passes through the top portion of the powder transport duct 41*a* and protrudes out of the same. On the protruded movable bar 24*a* is fitted the push-cap 27*a* having the auxiliary brush 29*a*. When the removing force from the main body 10*a* is forced upward, the main body 10*a* naturally falls down by the repulsive force of the spring 32, and at the same time, the auxiliary brush 29*a* enters into the powder transport duct 41*a*. As a result, a brush member 50*a* in a bundle form by a clip 52*a* is fitted and coupled around the powder transport duct 41*a*.

On the other hand, around the upper movable body 40*a* there is provided a brush cover 46 having slidable protrusion 46*a* at the inner bottom portion thereof. The protrusion 46*a* is adapted to engage with or disengage from the engaging groove 45. By covering the top portion of the brush member 50*a* with a cap 60, the present inventive cosmetics brush 1*a* is completed.

The functional effect of the above embodiments of the present invention, will be described in more detail as follows.

The cosmetics brush 1*a* according to the alternative embodiment of the present invention as shown in FIGS. 5 to 8 acts in substantially the same manner as the cosmetics brush 1 illustrated in FIGS. 1 to 4. More specifically, the cosmetics powder is charged into the main body 10*a*. The movable member 12, as the top portion of the main body 10*a*, is spaced from the upper movable body 40*a* and from bottom end part of the brush cover 46 at a desirable interval by the repulsive force of the spring 32. The push-cap 27*a* blocks the top portion of the threshold 42*a* formed inside the powder transport duct 41*a* of the upper movable body 40*a*.

Figure 8:
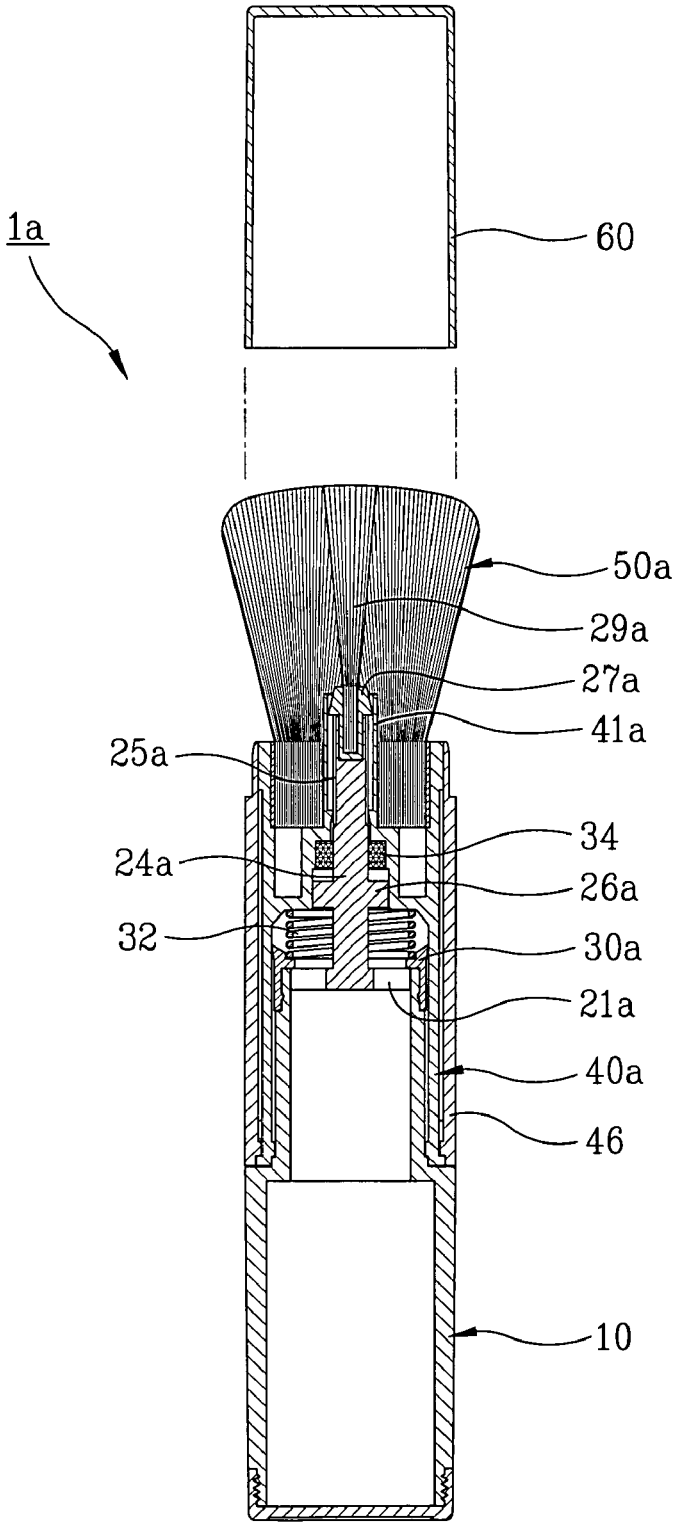
FIG. 8 is a sectional view of FIG. 6 showing a still further example of the present invention wherein the main body thereof is pushed up.

In order to receive the powder and discharge the powder into the brush member 50 in the condition where the powder transport duct 41*a* is closed by the push-cap 27*a* at the time of make-up, the user needs to only push the main body 10*a* upward with one hand while gripping the brush cover 46 integrated with the upper movable body 40*a* with the other hand. When the main body 10*a* is pushed up, the movable bar 24*a* above the movable member 12 is raised and allows the press-ring 26*a* around the movable bar 24*a* to apply pressure to the inner space 42*b* as the inner part of the upper movable body 40*a*, thereby discharging the cosmetics powder to the auxiliary brush side 29*a* and the brush side 50*a* through the vertical grooves 25*a* arranged around the movable bar 24*a* in the desired amount, as shown in FIG. 8. The auxiliary brush 29*a* has the role of distributing the powder uniformly around the brush member 50*a*.

Moreover, the powder to be delivered into the powder transport duct 41*a* predominantly passes through a filter 34 built in the upper movable body 40*a* to remove aggregates and/or impurities and to introduce only fine powder into the powder transport duct 41*a*.

On the other hand, the brush cover 46 coupled around the upper movable body 40*a* has another protrusion 46*a* at the inner lower portion thereof to be engaged with the engaging groove 45 at bottom end part of the upper movable body 40*a* and acts together with the upper movable body 40*a*.

When the force pushing up the main body 10*a* is removed, both the movable member 12 having the movable bar 24*a* and the main body 10 return to their original positions by the repulsive force of the spring 32 supporting the movable member 12.

As described above, repetition of the upward/downward movement is carried out by forcing the main body 10*a*. If not used, the main body 10*a* is pushed upward until it reaches the upper movable body 40*a* where the movement of the main body 10*a* is restricted by the engagement of the protrusion 45*a* on the inner lower portion of the upper movable body 40*a* in the groove 12*b* extending around the movable member 12. After locking the main body 10*a* as described above, the cosmetics brush 1 can be appropriately contained.

Figure 9:
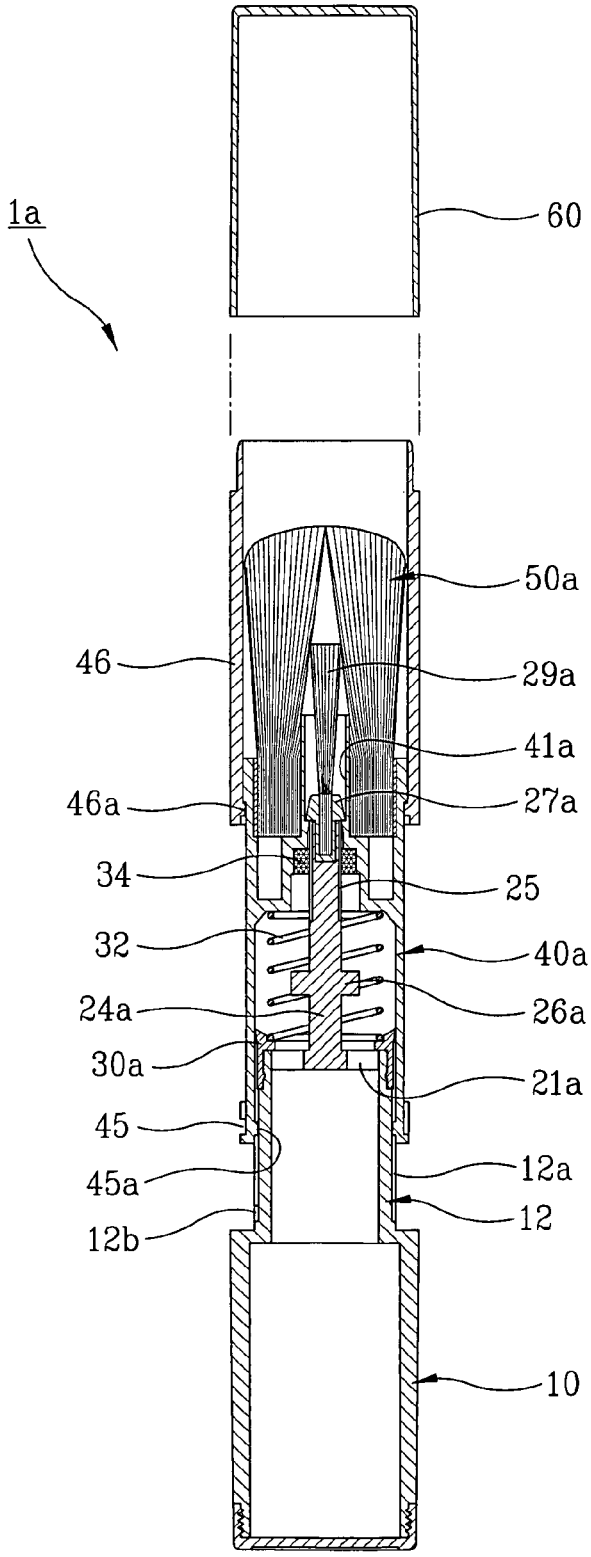
FIG. 9 is a sectional view of FIG. 6 showing the present invention with the brush cover thereof pushed up.
Figure 10:
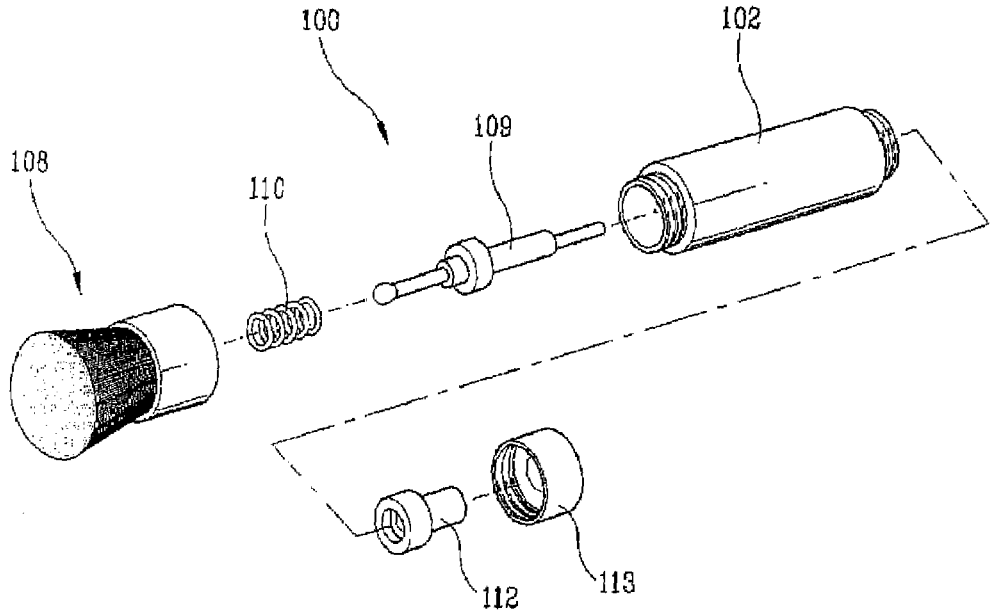
FIG 10 CONVENTIONAL ART
FIG. 10 is a perspective view showing a conventional cosmetics brush.
Figure 11:
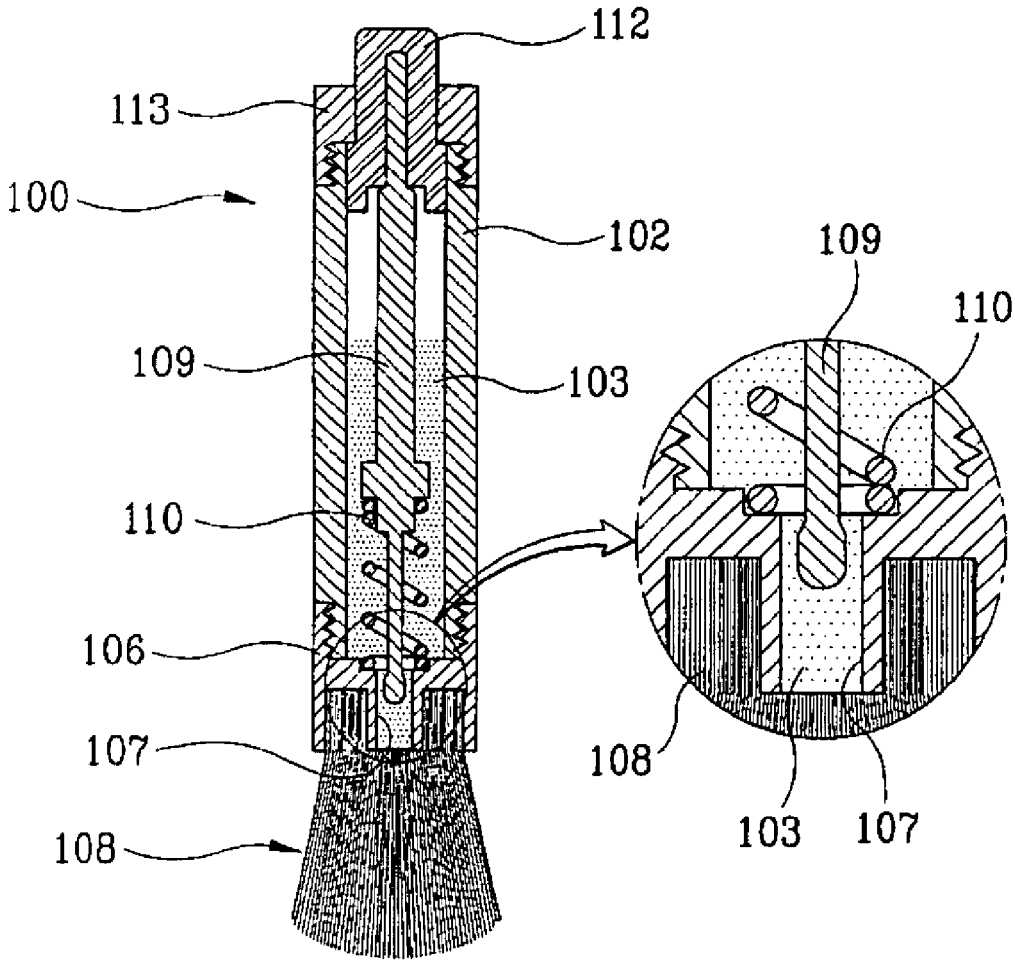
FIG. 11 is an exploded perspective view illustrating the conventional cosmetics brush.

As illustrated in FIG. 9, in the case where the protrusion 46*a* of the brush cover 46 enclosing the upper movable body 40*a* is released from the groove 45 of the upper movable body 40*a* then the brush cover 46 is pushed upward to join the brush member 50*a*, thereby conveniently connecting the brush member 50*a* with the cap 60 when the cosmetics brush is not in use.

By the repetitive pushing/releasing of the main body 10*a*, the cosmetics powder received in the main body 10*a* can pass through the powder transport duct 41*a* and move to the brush member 50, whereby it accomplishes the purpose of the present invention.

As described above, the cosmetics brush of the present invention is conveniently useable and effective to use with a simple operation wherein it can generate air pressure inside the main body by repeatedly moving the main body up and down whereby the powder inside the main body passes through the vertical grooves on the movable bar and the powder transport duct on the upper movable body to discharge the make-up to the brush member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics brush which comprises:

a main body for receiving a cosmetic powder;

an intermediate coupler screw-coupled to the top portion of the main body and formed with an auxiliary brush for distributing the powder to a main brush and a movable bar provided with vertical grooves and containing an opening/closing part with a threshold and a press-ring;

an upper movable body which includes a powder transport duct which is inserted by the movable bar into the intermediate coupler and having a threshold connected to the opening/closing part and is coupled with the intermediate coupler by means of guide grooves at both sides of inner bottom part of the movable body; and a repulsive spring disposed between the upper movable body and the intermediate coupler to hold the upper movable part apart from the main body at a desired interval, whereby when the main body is pushed up, the movable bar is raised which allows the press ring to apply pressure to the power transport duct thereby transporting cosmetic powder to the powder transport duct through the vertical grooves arranged around the movable bar, for discharge to the auxiliary brush which, in turn, distributes the cosmetic powder uniformly to the main brush.

2. A cosmetics brush which comprises:

a main body equipped with a movable bar provided with vertical grooves and operatively associated with an auxiliary brush and a press ring provided at a top portion thereof and combined with a movable member having a moving groove and an engaging groove disposed thereon;

a powder transport duct connected to the top portion of the main body and having a threshold for fitting and coupling the movable member, and an upper movable body formed with an engaging groove and a protrusion;

a brush cover for covering the upper movable body and for sliding up and down to collect the brush member, a cap for covering the top portion of the brush member, said brush cover containing protrusions at the inner bottom portion thereof for slidably engaging with or disengaging from the engaging groove prepared at the bottom portion of the upper movable body; and a repulsive spring inserted between the upper movable body and the main body to keep the upper movable body apart from the main body at a desired interval.

3. The cosmetic brush of claim 1, wherein the auxiliary brush is provided with vertical grooves.

* * * * *